US006857435B2

(12) United States Patent
Boyd et al.

(10) Patent No.: US 6,857,435 B2
(45) Date of Patent: Feb. 22, 2005

(54) METHOD AND APPARATUS FOR COOLING A RESONATOR OF A MEGASONIC TRANSDUCER

(75) Inventors: John M. Boyd, Atascadero, CA (US); John deLarios, Palo Alto, CA (US); Carl Woods, Aptos, CA (US)

(73) Assignee: Lam Research Corporation, Fremont, CA (US)

( * ) Notice: Subject to any disclaimer, the term of this patent is extended or adjusted under 35 U.S.C. 154(b) by 4 days.

(21) Appl. No.: 10/803,118

(22) Filed: Mar. 16, 2004

(65) Prior Publication Data

US 2004/0173238 A1 Sep. 9, 2004

Related U.S. Application Data

(62) Division of application No. 10/187,162, filed on Jun. 28, 2002, now Pat. No. 6,729,339.

(51) Int. Cl.[7] ..... C25F 5/00

(52) U.S. Cl. ..... 134/1.3; 134/1; 134/34; 134/42; 134/184; 366/127

(58) Field of Search ..... 134/1, 1.3, 34, 134/42, 184; 366/127

(56) References Cited

U.S. PATENT DOCUMENTS 5,562,778 A * 10/1996 Koretsky et al. ..... 134/1
6,644,327 B1 * 11/2003 Mitsumori et al. ..... 134/184

* cited by examiner

*Primary Examiner*—M. Kornakov
(74) *Attorney, Agent, or Firm*—Martine & Penilla, LLP

(57) ABSTRACT

A method for cleaning a semiconductor substrate with a sonic cleaner is provided. The method initiates by introducing a cooling fluid into an inner jacket region of a sonic cleaner to cool a sonic resonator positioned within the inner jacket region. Then, a cleaning agent is introduced into an outer jacket region of the sonic cleaner to clean a semiconductor substrate. Next, a cooling fluid/cleaning agent interface is defined at an orifice location between the inner jacket region and the outer jacket region. Then, sonic energy from the resonator is transmitted to the cleaning agent through the interface at the orifice. Next, the cleaning agent is applied to the semiconductor substrate.

14 Claims, 6 Drawing Sheets

METHOD AND APPARATUS FOR COOLING A RESONATOR OF A MEGASONIC TRANSDUCER

CROSS REFERENCE TO RELATED APPLICATION

This application is a divisional application of U.S. patent application Ser. No. 10/187,162, filed on Jun. 28, 2002, now U.S. Pat. No. 6,729,339 and entitled "METHOD AND APPARATUS FOR COOLING A RESONATOR OF A MEGASONIC TRANSDUCER." The disclosure of this related application is incorporated herein by reference for all purposes.

BACKGROUND OF THE INVENTION

The present invention relates generally to surface cleaning and, more particularly, to a method and apparatus for megasonic cleaning of a semiconductor substrate following fabrication processes.

Megasonic cleaning is widely used in semiconductor manufacturing operations and can be employed in a batch cleaning process or a single wafer cleaning process. For a batch cleaning process, the vibrations of a megasonic transducer creates sonic pressure waves in the liquid of the cleaning tank which contains a batch of semiconductor substrates. A single wafer megasonic cleaning process often uses a relatively small transducer above a rotating wafer, wherein the transducer is scanned across the wafer using a liquid stream coupling, or in the case of full immersion in a single wafer tank system a larger transducer which can couple to a larger portion of the wafer. In each case, the primary particle removal mechanism from megasonic cleaning is by cavitation and acoustic streaming. Cavitation is the rapid forming and collapsing of microscopic bubbles in a liquid medium under the action of sonic agitation. Upon collapse, the bubbles release energy which assists in particle removal by breaking the various adhesion forces which cause the particles to adhere to the substrate. Sonic agitation involves subjecting the liquid to acoustic energy waves. Under megasonic cleaning, these acoustic waves occur at frequencies between 0.4 and 1.5 Megahertz (MHz), inclusive. Lower frequencies have been used for other cleaning applications in the ultrasonic range, but these applications are used primarly for part cleaning, and not semiconductor substrate cleaning, due to the potential for damage to the substrates at the lower frequencies.

FIG. 1A is a schematic diagram of a batch megasonic cleaning system. Tank 100 is filled with a cleaning solution. Wafer holder 102 includes a batch of wafers to be cleaned. Transducer 104 creates pressure waves through sonic energy with frequencies near 1 Megahertz. These pressure waves act in concert with the appropriate chemistry to control particle re-adhesion and provide the cleaning action. Because of the long cleaning times and chemical usage required for batch cleaning systems, efforts have been focused on single wafer cleaning systems in order to decrease chemical usage, increase wafer-to-wafer control, and decrease defects in accordance with the International Technology Roadmap for Semiconductors (ITRS) requirements. Batch systems suffer from another disadvantage in that the delivery of megasonic energy to the multiple wafers in the tank is non-uniform and can result in 'hot spots' due to constructive interference, or 'cold spots' due to destructive interference, each being caused by reflection of the megasonic waves from both the multiple wafers and from the megasonic tank walls. Therefore, a higher megasonic energy as well as multiple transducer arrays must be applied in order to reach all regions of the wafers in wafer holder 102. Single wafer megasonic which couple to the wafer through a meniscus also suffer from reflected power reducing the cleaning efficiency. FIG. 1B is a schematic diagram of a single wafer cleaning tank. Here, tank 106 is filled with a cleaning solution. Wafer 108 is submerged in the cleaning solution of tank 106. Transducer 110 supplies the energy to clean the wafer. One shortcoming of the single wafer cleaning tank is that particles remain inside the tank requiring that the cleaning fluid be replaced or re-circulated and filtered regularly. Furthermore, removal of the wafer from the tank after megasonic cleaning also runs the risk of particle reattachment.

FIG. 1C is a schematic diagram of nozzle-type megasonic cleaning configuration for a single wafer. Nozzle 112 provides fluid stream 114 through which the megasonic energy is coupled. Transducer 116, which is connected to power supply 118, provides the megasonic energy through the fluid stream 114 to the substrate as the fluid stream flows through the nozzle. Megasonic energy supplied through fluid stream 114 provides the cleaning mechanism to clean wafer 120. One shortcoming of the nozzle cleaning configuration includes requiring a high flow rate of fluid stream 114 to cool the transducer 116. Fluid stream 114 generated through nozzle 112 covers a small area, therefore, a fairly high megasonic energy is needed to clean the wafer in a reasonable time. The high energy required here necessitates cooling of the transducer. Consequently, the high flow rate of fluid stream 114 is due in good part to the cooling requirements, which are driven by the high energy requirements. This makes cleaning using a cleaning chemistry other than deionized water less desirable, due to cost associated with the high flow rates and effluent handling requirements.

In view of the foregoing, there is a need for a method and apparatus to provide a single wafer magasonic cleaning configuration that is capable of cooling the transducer or resonator while limiting the volume of cleaning chemistry consumed.

SUMMARY OF THE INVENTION

Broadly speaking, the present invention fills this need by providing a megasonic cleaner that is configured to provide cooling to the resonator with a fluid stream separate from the cleaning chemistry fluid stream. It should be appreciated that the present invention can be implemented in numerous ways, including as an apparatus, a system, a device, or a method. Several inventive embodiments of the present invention are described below.

In accordance with one aspect of the present invention, a device for cleaning a semiconductor substrate is provided. The device includes a resonator for propagating megasonic energy. The device has a double jacketed housing having an inner jacket and an outer jacket. The double jacketed housing includes an inner jacket region defined within the inner jacket. The inner jacket region at least partially encloses the resonator. The inner jacket region includes a bottom outlet, a cooling fluid inlet and a cooling fluid outlet. The bottom outlet is located so that energy propagated through a cooling fluid in contact with the resonator can pass through the bottom outlet. An outer jacket region defined between the outer jacket and the inner jacket is included. The outer jacket region includes a cleaning agent inlet and a cleaning agent outlet. The cleaning agent outlet is substantially aligned with the bottom outlet. A cylindrical arm having a first end and a second end is included. The first end of the cylindrical arm extends from the cleaning agent outlet, the second end of the cylindrical arm has a nozzle disposed thereon.

In accordance with another aspect of the invention, a system for cleaning a semiconductor substrate is provided. The system includes a substrate support configured to support and rotate a semiconductor substrate about an axis of the semiconductor substrate. A megasonic cleaner configured to move radialy above a top surface of the semiconductor substrate is included. The megasonic cleaner includes a transducer and a resonator affixed to the transducer. The megasonic cleaner has a double jacketed housing having an inner jacket and an outer jacket. The double jacketed housing includes an inner jacket region defined within the inner jacket. The inner jacket region is at least partially enclosed by the resonator. The inner jacket region has a bottom outlet, a cooling fluid inlet and a cooling fluid outlet. The bottom outlet is located so that energy propagated through a cooling fluid in contact with the resonator can pass through the bottom outlet. The double jacketed housing includes an outer jacket region defined between the outer jacket and the inner jacket. The outer jacket region has a cleaning agent inlet and a cleaning agent outlet. The cleaning agent outlet is substantially aligned with the bottom outlet. The megasonic cleaner includes a cylindrical arm having a first end and a second end. The first end of the cylindrical arm is attached to the cleaning outlet and the second end of the cylindrical arm has a nozzle attached thereto.

In accordance with another aspect of the invention, a method for cleaning a semiconductor substrate with a sonic cleaner is provided. The method initiates by introducing a cooling fluid into an inner jacket region of a sonic cleaner to cool a sonic resonator positioned within the inner jacket region. Then, a cleaning agent is introduced into an outer jacket region of the sonic cleaner to clean a semiconductor substrate. Next, a cooling fluid/cleaning agent interface is defined at an orifice located between the inner jacket region and the outer jacket region. Then, sonic energy from the resonator is transmitted to the cleaning agent through the interface at the orifice. Next, the cleaning agent is applied to the semiconductor substrate.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE INVENTION

Figure 1A:
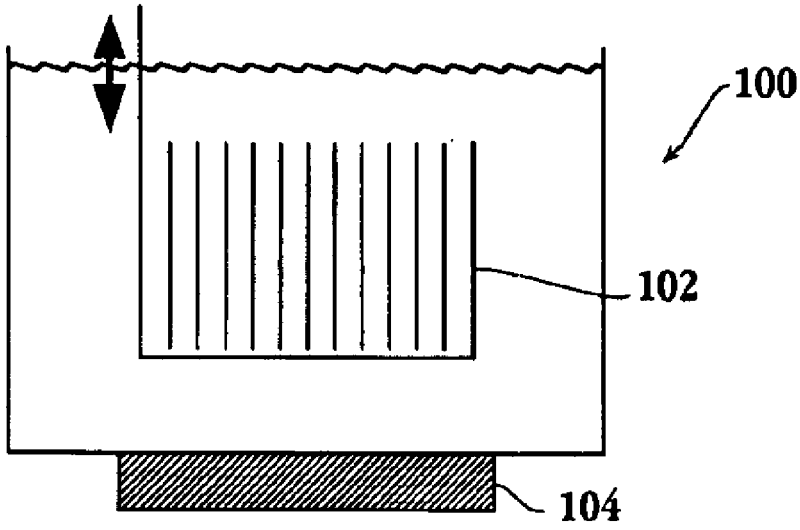
Fig. 1A (prior art)
FIG. 1A is a schematic diagram of a batch megasonic cleaning system.
Figure 1B:
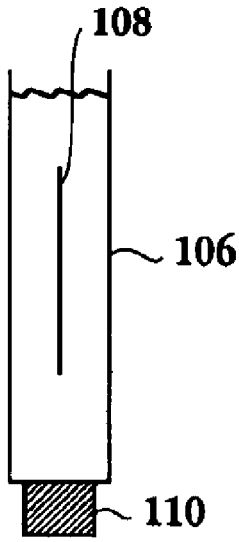
Fig. 1B (prior art)
FIG. 1B is a schematic diagram of a single wafer cleaning tank.
Figure 1C:
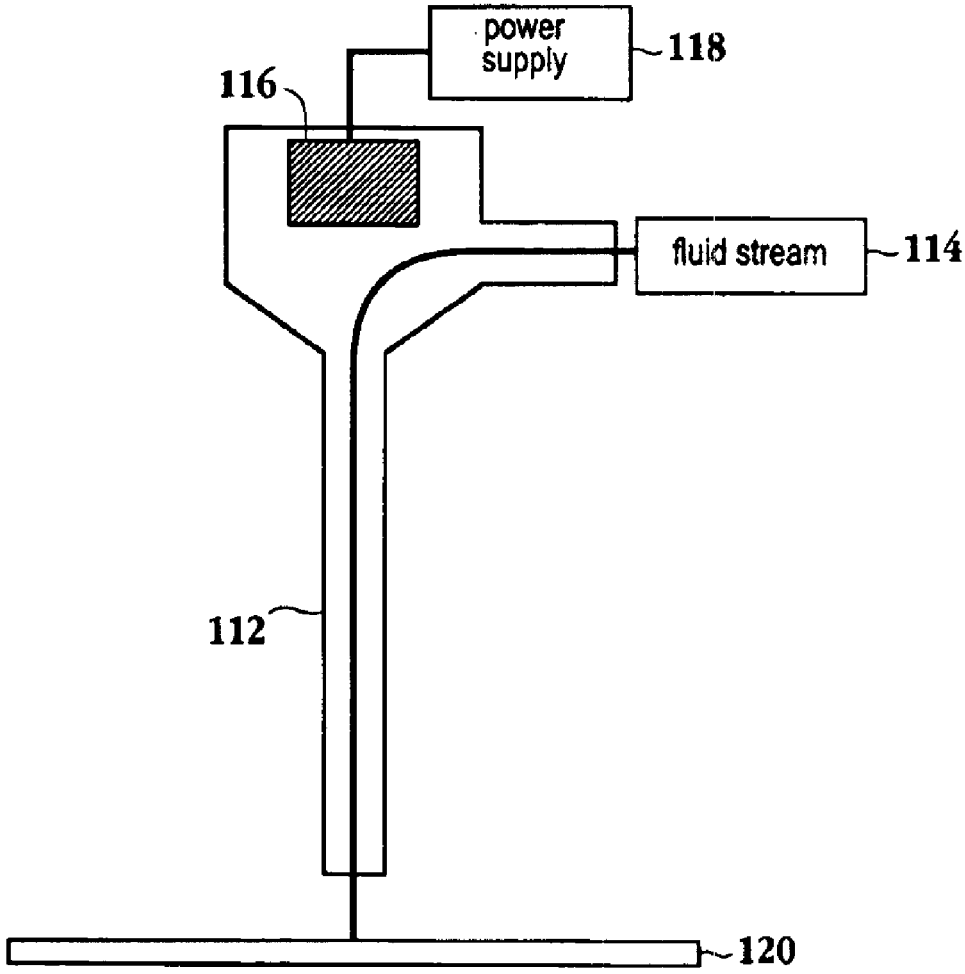
Fig. 1C (prior art)
FIG. 1C is a schematic diagram of nozzle cleaning configuration for a single wafer.

Several exemplary embodiments of the invention will now be described in detail with reference to the accompanying drawings. FIGS. 1A, 1B and 1C are discussed above in the "Background of the Invention" section.

The embodiments of the present invention provide an apparatus and a method for cleaning a semiconductor substrate with a megasonic cleaning device. The cleaning device is configured to minimize the use of a cleaning agent, such as a post-etch cleaning chemistry or a post-chemical mechanical planarization (CMP) cleaning chemistry. In one embodiment, a double jacketed megasonic wand is provided. The megasonic wand includes an inner jacket and an outer jacket, wherein the outer jacket surrounds the sides and the bottom of the inner jacket in one embodiment. A cooling fluid flows through the area defined by the inner jacket to cool a resonator located at least partially within the area defined by the inner jacket. A cleaning agent flows into the area defined between the outer jacket and the inner jacket. The cooling fluid and the cleaning agent are coupled at an interface formed through an orifice of the inner jacket. The coupled fluids allow for the transfer of sonic energy from the cooling fluid to the cleaning agent. The cleaning agent then transfers the sonic energy to the surface of a semiconductor substrate being cleaned. As used herein, the term about refers to a reasonable approximation of the specific range provided, such as +/−10% of the process range.

Figure 2:
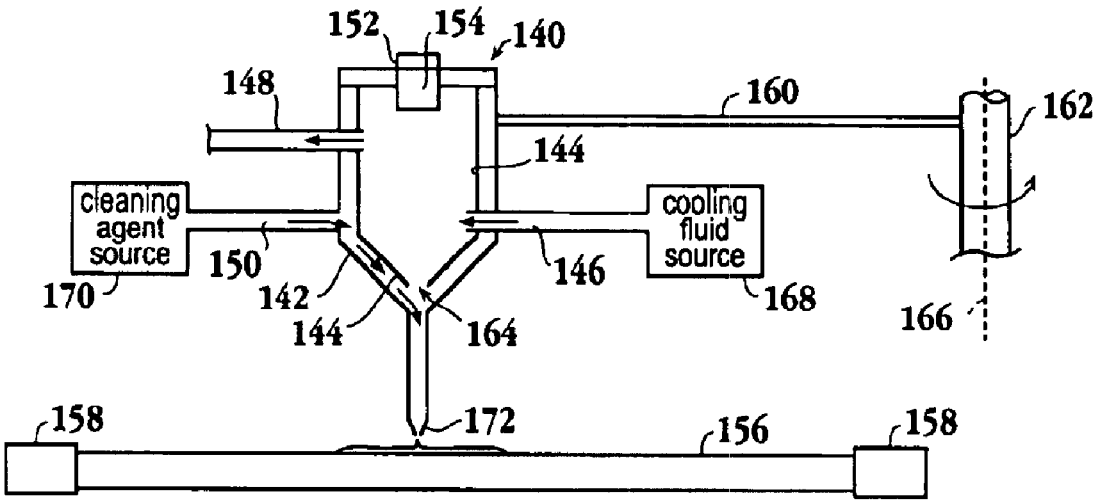
FIG. 2 is a simplified cross-sectional view schematic diagram of a megasonic wand configured to clean a surface of a semiconductor substrate with a minimal amount of a cleaning agent in accordance with one embodiment of the invention.

FIG. 2 is a simplified cross-sectional view schematic diagram of a megasonic wand configured to clean a surface of a semiconductor substrate with a minimal amount of a cleaning agent in accordance with one embodiment of the invention. Megasonic wand 140 includes inner jacket 144 and outer jacket 142. Sonic transducer 152 is coupled to resonator 154. Resonator 154 extends at least partially into the area defined within inner jacket 144. Megasonic wand 140 is affixed to a first end of arm 160, while shaft 162 is attached to a second end of arm 160. Shaft 162 is configured to rotate about axis 166. Accordingly, megasonic wand 140 moves radially over wafer 156. Wafer 156 is supported by rollers 158 which are configured to rotate wafer 156 about an axis of the wafer as megasonic wand 140 moves radially over the wafer.

Still referring to FIG. 2, the region defined within inner jacket 144 is accessed through inlet 146. Outlet 148 provides an exit for fluid introduced to the region defined within inner jacket 144. For example, a cooling fluid can be supplied to the region defined within inner jacket 144 through inlet 146. In one embodiment, the continuous flow of cooling fluid from cooling fluid source 168 enters through inlet 146 and exits through outlet 148. The cooling fluid dissipates heat generated by resonator 154 which is transferred from sonic transducer 152. A cleaning agent, such as a cleaning chemistry formulated for a post-etch cleaning or a post-CMP cleaning of a single wafer, is introduced into the region defined between outer jacket 142 and inner jacket 144. In one embodiment, the cleaning agent is introduced from cleaning agent source 170, through cleaning agent inlet 150, and exits megasonic wand 140 through nozzle 172 to the surface of wafer 156. Sonic energy, such as megasonic energy, originates from transducer 152 and is transmitted through resonator 154. Resonator 154 propagates the sonic energy to the cooling agent within the region defined between inner jacket 144. The cooling fluid is coupled to the cleaning agent through orifice 164. In one embodiment, orifice 164 is a hole located at a bottom region of inner jacket 144 having a diameter between about 1 millimeter (mm) and about 5 mm. Thus, the sonic energy of the cooling fluid is transferred to the cleaning agent through the interface at orifice 164. The cleaning agent is applied to the surface of wafer 156. The cleaning activity of the cleaning chemistry is enhanced through the cavitation caused by the megasonic energy applied with the cleaning chemistry to the surface of wafer 156. It should be appreciated that the combination of the megasonic energy and the cleaning chemistry being applied to the surface of wafer 156 improves wetting and cleaning, especially with respect to high aspect ratio features.

The cooling fluid introduced to megasonic wand 140 of FIG. 2 provides the necessary cooling for resonator 154 which is affixed to transducer 152. One skilled in the art will appreciate that the crystal of transducer 152 heats-up as the megasonic energy is generated. This heat is transferred to resonator 154. If the heat is not dissipated, then the transducer can fail. A relatively high flow rate of cooling fluid is needed to dissipate this heat. That is, the flow rate of the cooling fluid is higher than the flow rate needed for applying the cleaning chemistry to the surface of the wafer. Therefore, the present embodiment allows for a cooling fluid to be applied to a flow rate sufficient to dissipate the heat generated by transducer 152 and resonator 154, while the cleaning chemistry can be applied at a lower flow rate to clean the surface of wafer 156. In one embodiment, the cooling fluid is deionized water (DIW). Accordingly, where DIW is the cooling fluid, resonator 154 does not come into contact with the aggressive cleaning chemistries used for the cleaning processes and is protected from attack by the chemicals. Examples of single wafer cleaning chemistries commonly used for post-etch cleaning include commercially available proprietary chemicals, such as EKC 640, EKC 6800 and Ashland NE89. Commercially available non-proprietary chemicals used for post chemical mechanical planarization cleaning are generally known and include SC-1($NH_4OH/H_2O_2$ mixture), SC-2 ($HCl/H_2O_2$ mixture), dilute HF or ozonated DIW ($H_2O/O_3$).

Figure 3:
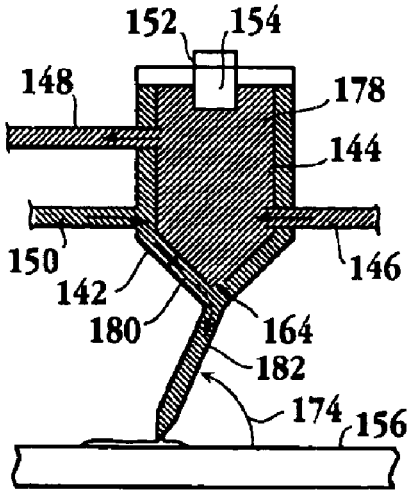
FIG. 3 is a simplified cross-sectional view of a megasonic transducer wand directing a cleaning chemistry flow at an angle to the surface of a wafer in accordance with one embodiment of the invention.

FIG. 3 is a simplified cross-sectional view of a megasonic transducer wand directing a cleaning chemistry flow at an angle to the surface of a wafer in accordance with one embodiment of the invention. Resonator 154, which is affixed to transducer 152, is partially contained within region 178, which is defined within inner jacket 144. Cooling fluid flows into region 178 through inlet 146 and flows out of region 178 through outlet 148, wherein the flow of cooling fluid dissipates heat generated through resonator 154. At the same time, a cleaning agent is supplied to region 180, which is defined between outer jacket 142 and inner jacket 144, through inlet 150. The cleaning agent is directed to the surface of wafer 156 through outer jacket extension 182. Outer jacket extension 182 is configured to direct the flow of the cleaning fluid at angle 174 to the surface of wafer 156. In one embodiment, angle 174 is between about 5 degrees and 40 degrees. In a preferred embodiment, angle 174 is about 30 degrees. Megasonic energy propagated through resonator 154 is transferred to the cooling fluid, which is then transferred to the cleaning agent at an interface coupling the cooling fluid and the cleaning agent. The megasonic energy is then supplied with the cleaning agent to the surface of wafer 156 at angle 174 through outer jacket extension 182.

Still referring to FIG. 3, angle 174 minimizes the reflected power seen by the megasonic wand. When the megasonic wand delivers the flow and megasonic energy to wafer 156 in a substantially perpendicular configuration, some of the sonic energy is reflected from the surface of the wafer and essentially reduces the power delivered to the surface of the wafer. Thus, by angling the delivery of the fluid stream, which is delivering the megasonic energy, the reflected power is minimized. In turn, the cleaning effectiveness is enhanced since the amount of energy delivered to wafer 156 is increased. As will be explained in more detail below, orifice 164 is substantially aligned with opening 176 of outer jacket extension 182 to allow for the transfer of the sonic energy from the cooling fluid to the cleaning agent being delivered to the surface of wafer 156.

Figure 4:
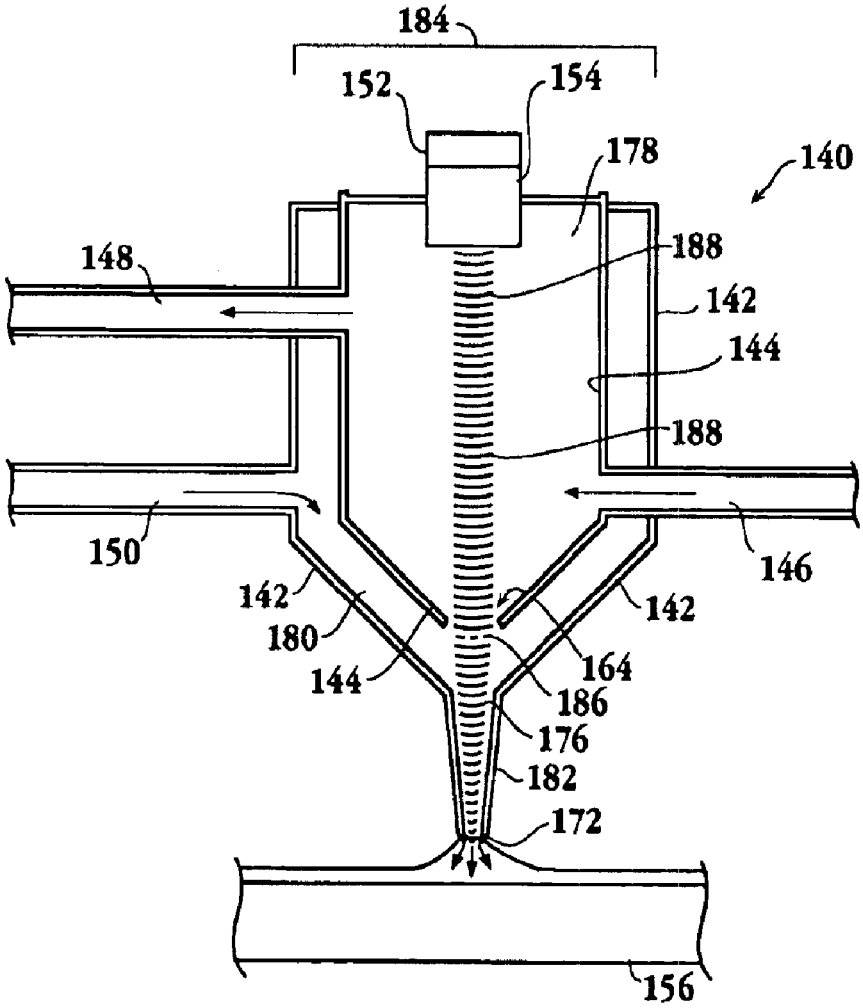
FIG. 4 is an enlarged schematic diagram of a megasonic transducer wand illustrating the interface between the cooling fluid and the cleaning agent in accordance with one embodiment of the invention.

FIG. 4 is an enlarged schematic diagram of a megasonic transducer wand illustrating the interface between the cooling fluid and the cleaning agent in accordance with one embodiment of the invention. In one embodiment, diameter 184 of the main body of the megasonic wand is between about ½inches and about ¾ inches. Sonic energy 188 originating from transducer 152 through resonator 154 is propagated through the cooling fluid. The cleaning agent is coupled to the cooling fluid through interface 186 located proximate to orifice 164. In one embodiment, interface 186 is maintained by balancing the pressures inside regions 178 and 180. More particularly, the pressure within region 178, defined within inner jacket 144, is in part a function of the flow rate of the cooling fluid supplied through inlet 146. Likewise, the pressure within region 180, defined between outer jacket 142 and inner jacket 144, is in part a function of the flow rate of the cleaning agent supplied through inlet 150. The corresponding pressures associated with the flow rates are balanced so that the dilution of the cleaning chemistry by the cooling fluid is minimized, while resonator 154 is substantially isolated from the cleaning chemistry.

Accordingly, interface 186 of FIG. 4 is formed as a fluid boundary layer coupling the cooling fluid to the cleaning chemistry near orifice 164. That is, the pressure exerted by the cooling fluid and the pressure exerted by the cleaning chemistry at orifice 164 are configured to minimize mixing of the fluids. The cleaning agent is ejected to the surface of wafer 156 through nozzle 172 at an end of outer jacket extension 182. In one embodiment, the diameter of nozzle 172 is between about 1 millimeter (mm) and about 4 mm. Of course, outer jacket extension 182 can be angled to deliver a cleaning agent fluid stream at an angle to the surface of wafer 156. In another embodiment, megasonic wand 140 can be tilted from its axis to deliver the cleaning agent fluid stream at an angle to the surface of wafer 156.

Figure 5:
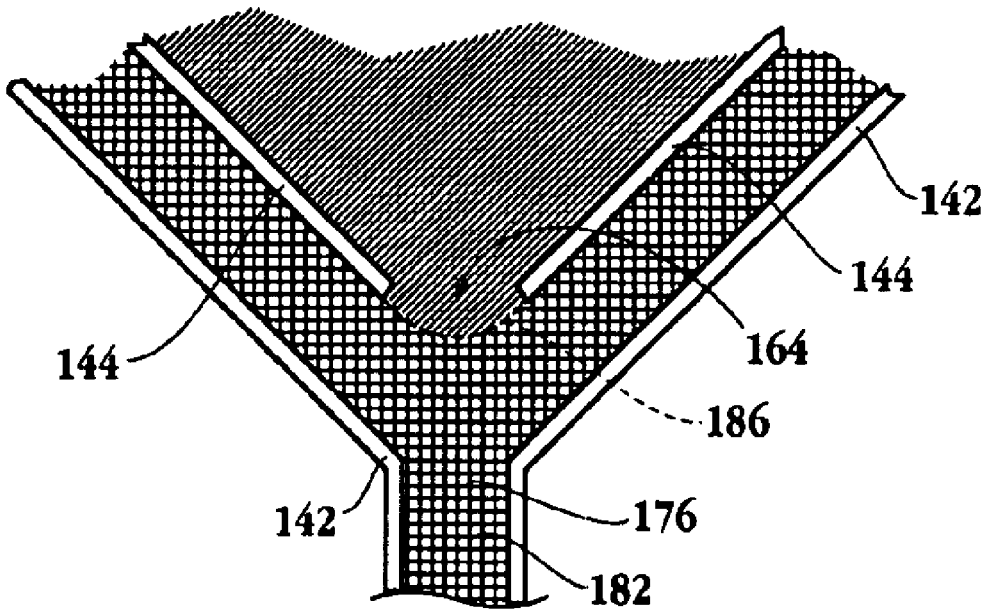
FIG. 5 is an enlarged cross-section of the interface region between the cooling fluid and the cleaning agent of the megasonic wand in accordance with one embodiment of the invention.

FIG. 5 is an enlarged cross-section of the interface region between the cooling fluid and the cleaning agent of the megasonic wand in accordance with one embodiment of the invention. Here, orifice 164 is substantially aligned with opening 176 of outer jacket extension 182. In one embodiment, orifice 164 defined through inner jacket 144 has a diameter of between about 1 mm and about 5 mm In another embodiment, opening 176 defined through outer jacket 142 has a diameter substantially similar to the diameter of orifice 164. As described above, interface 186 is located proximate to orifice 164. Therefore, sonic energy is transferred across interface 186 to assist in the cleaning of the wafer, thereby combining the chemical cleaning with the megasonic cleaning so that the cleaning processes run in parallel rather than in series.

Figure 6:
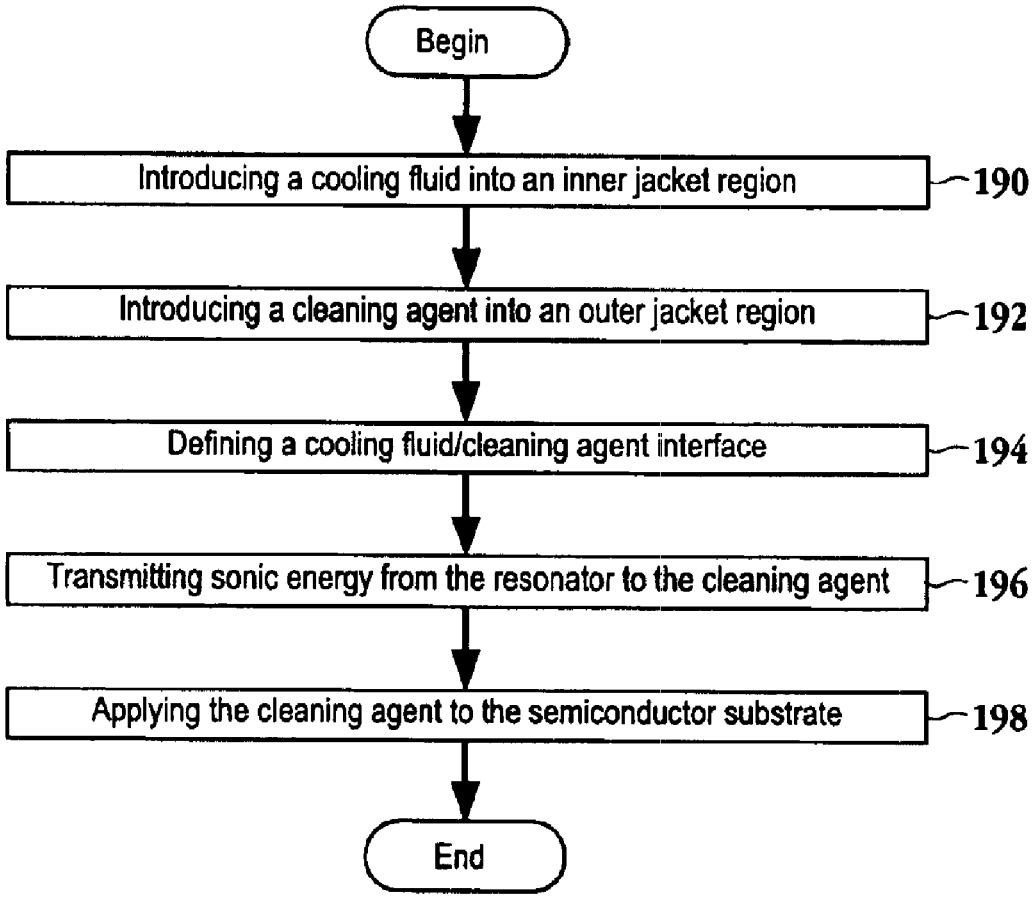
FIG. 6 is a flowchart diagram of the method operations for cleaning a semiconductor substrate, i.e., wafer, with a sonic cleaner in accordance with one embodiment of the invention.

FIG. 6 is a flowchart diagram of the method operations for cleaning a semiconductor substrate, i.e., wafer, with a sonic cleaner in accordance with one embodiment of the invention. The method begins with operation 190 where a cooling fluid is introduced to an inner jacket region of a megasonic cleaner. For example, a cooling fluid can be introduced into inner jacket region having an inlet and an outlet as described with reference to FIGS. 2–4. In one embodiment, the cooling fluid is deionized water. In another embodiment, the cooling fluid is supplied from a pump in communication with a reservoir filled with the cooling fluid. The method then advances to operation 192 where a cleaning agent is introduced into an outer jacket region of a megasonic cleaner. As described with reference to FIGS. 2–4, the cleaning agent is introduced through an inlet to the outer jacket region, where the outer jacket region is located between the inner jacket and the outer jacket of the megasonic transducer wand. In one embodiment, the cleaning agent is a commercially available post-etch or post-CMP cleaning chemistry for a single wafer cleaning operation as described above.

The method then moves to operation 194 where a cooling fluid/cleaning agent interface is defined. In one embodiment, the interface is located at an orifice located at a bottom region of the inner jacket, as described with reference to FIGS. 4 and 5. The cleaning fluid/cleaning agent interface is created due to the pressure relationship between the cleaning agent in the outer jacket region and the cooling fluid in the inner jacket region. That is, the pressure between the fluids at the interface is such that dilution of the cleaning agent by the cooling fluid is minimized, while a resonator being cooled by the cooling fluid is isolated from the aggressive chemistry of the cleaning agent. The method then advances to operation 196 where the sonic energy from the resonator is transmitted to the cleaning agent. As described above, megasonic energy from the resonator is transferred to the cooling fluid used to cool the resonator. The interface that couples the cooling fluid to the cleaning agent at the orifice allows for the propagation of the sonic energy from the cooling fluid to the cleaning agent. The method then proceeds to operation 198 where the cleaning agent is applied to the semiconductor substrate. Here, the cleaning process is augmented by the megasonic energy supplied to the semiconductor substrate with the cleaning agent. In one embodiment, the cleaning agent is supplied at an angle to the surface of the semiconductor substrate being cleaned to minimize reflected power.

In summary, the present invention provides a megasonic transducer wand configured to minimize an amount of cleaning chemistry used to clean a wafer. The transducer wand allows for the introduction of a cooling fluid to dissipate the heat generated through the resonator. Thus, the cleaning chemistry can be provided at a low flow rate as the cooling fluid supplies the necessary cooling capacity. The cooling fluid and the cleaning chemistry, i.e., cleaning agent, are coupled at an interface defined near an orifice through the inner jacket of the megasonic transducer wand. The interface is formed by balancing the pressures of the cleaning agent and the cooling fluid in their respective regions to minimize cross-over of one fluid to another. In one embodiment, the cleaning agent is delivered to the surface of a wafer to be cleaned at an angle to reduce reflected power back sent back towards the transducer.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims.

What is claimed is:

1. A method for cleaning a semiconductor substrate with a sonic cleaner, the method comprising:

introducing a cooling fluid into an inner jacket of a sonic cleaner to cool a sonic resonator positioned within the inner jacket;

introducing a cleaning agent into an outer jacket of the sonic cleaner to clean a semiconductor substrate;

defining a cooling fluid/cleaning agent interface at an orifice located between the inner jacket and the outer jacket;

transmitting sonic energy from the resonator to the cleaning agent through the interface at the orifice; and applying the cleaning agent to the semiconductor substrate.

2. The method of claim 1, wherein applying the cleaning agent to the semiconductor substrate further includes:

directing the cleaning agent to impact the semiconductor substrate at an angle.

3. The method of claim 2, wherein the angle is between about 5 degrees and about 40 degrees.

4. The method of claim 1, wherein defining a cooling fluid/cleaning agent interface at an orifice located between the inner jacket and the outer jacket further includes, balancing a pressure of a cooling fluid in the inner jacket and the cleaning agent in the outer jacket to minimize dilution of the cleaning agent by the cooling fluid.

5. The method of claim 1, wherein the cleaning agent is heated.

6. The method of claim 1, wherein the resonator is a megasonic resonator.

7. A method for cleaning a semiconductor substrate, comprising a sonic cleaner:

defining a cooling fluid/cleaning agent interface at an orifice located between an inner jacket and an outer jacket of the sonic cleaner; and balancing a pressure exerted by a cooling fluid within the inner jacket and a pressure exerted by a cleaning agent within the outer jacket of the sonic cleaner to minimize dilution of the cleaning agent by the cooling fluid.

8. The method of claim 7, further comprising:

transmitting sonic energy from a resonator to the cleaning agent through the interface at the orifice.

9. The method of claim 7, further comprising:

applying the cleaning agent to the semiconductor substrate.

10. The method of claim 7, further comprising:

directing the cleaning agent to impact the semiconductor substrate at an angle.

11. The method of claim 7, further comprising:

directing the cleaning agent to impact the semiconductor substrate at an angle between about 5 degrees and about 40 degrees.

12. The method of claim 8, further comprising:

locating the resonator within a region defined by the inner jacket.

13. The method of claim 8, further comprising:

aligning an axis of the resonator with an axis of the interface.

14. The method of claim 8, wherein the resonator is a megasonic resonator.

* * * * *